US007036856B2

(12) United States Patent
Fishencord

(10) Patent No.: US 7,036,856 B2
(45) Date of Patent: May 2, 2006

(54) SPRING CAGE ASSEMBLY

(75) Inventor: Eric E. Fishencord, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 184 days.

(21) Appl. No.: 10/379,879

(22) Filed: Mar. 5, 2003

(65) Prior Publication Data

US 2004/0174020 A1 Sep. 9, 2004

(51) Int. Cl.
*E05B 3/00* (2006.01)

(52) U.S. Cl. ..... 292/336.3; 292/DIG. 61

(58) Field of Classification Search ..... 292/336.3, 292/357, 358, DIG. 61, DIG. 64
See application file for complete search history.

(56) References Cited

U.S. PATENT DOCUMENTS 2,729,485 A * 1/1956 Schlage ..... 292/1
4,911,489 A * 3/1990 Hansen et al. ..... 292/336.3
4,998,760 A * 3/1991 Nixon et al. ..... 292/347
5,265,924 A * 11/1993 Kim ..... 292/336.3
5,286,074 A * 2/1994 Lin ..... 292/336.3
5,590,555 A 1/1997 Kester et al.

OTHER PUBLICATIONS

ST Series, website article from PDQ Locks dated Nov. 8, 2002.

* cited by examiner

*Primary Examiner*—Gary Estremsky
(74) *Attorney, Agent, or Firm*—Michael Best & Friedrich LLP

(57) ABSTRACT

A spring cage assembly that includes a housing, a plurality of springs, and a drive spindle. The housing includes a centrally located opening and a plurality of housing tabs located radially around the opening underneath the housing. The plurality of springs are biased against the housing tabs. The drive spindle includes a first and a second end. The first end extends through the opening for connection to a door lever. The second end is integral with a torque plate having a plurality of plate tabs. The plate tabs compress the springs against the housing tabs in biasing rotation of the drive spindle.

21 Claims, 5 Drawing Sheets

SPRING CAGE ASSEMBLY

FIELD OF INVENTION

The present invention relates to a lock assembly. In particular, the present invention relates to a spring cage assembly for a cylindrical lock assembly.

BACKGROUND OF INVENTION

Door lock assemblies typically include interior and exterior door levers that rotate to extend and retract a latch assembly in securing access through a door.

SUMMARY OF THE INVENTION

One problem with lock assemblies is the difficulty in providing a spring return assembly for a door lever that is easy to assemble and requires fewer parts. The present invention provides an innovative lock assembly that can be readily assembled and requires fewer components to enhance its desirability with installers of lock assemblies.

In one embodiment, the invention provides a spring cage assembly comprising a housing having a centrally located opening, and a plurality of housing tabs located underneath the housing, a plurality of springs located underneath the housing and biased against the housing tabs, and a drive spindle having a first and second end, the first end extending through the opening for connection to a door lever, the second end having an integral torque plate with a plurality of plate tabs, wherein the plate tabs compress the springs against the housing tabs in biasing rotation of the drive spindle.

As is apparent from the above, it is an aspect of the invention to provide a spring cage assembly for a door lock assembly. Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
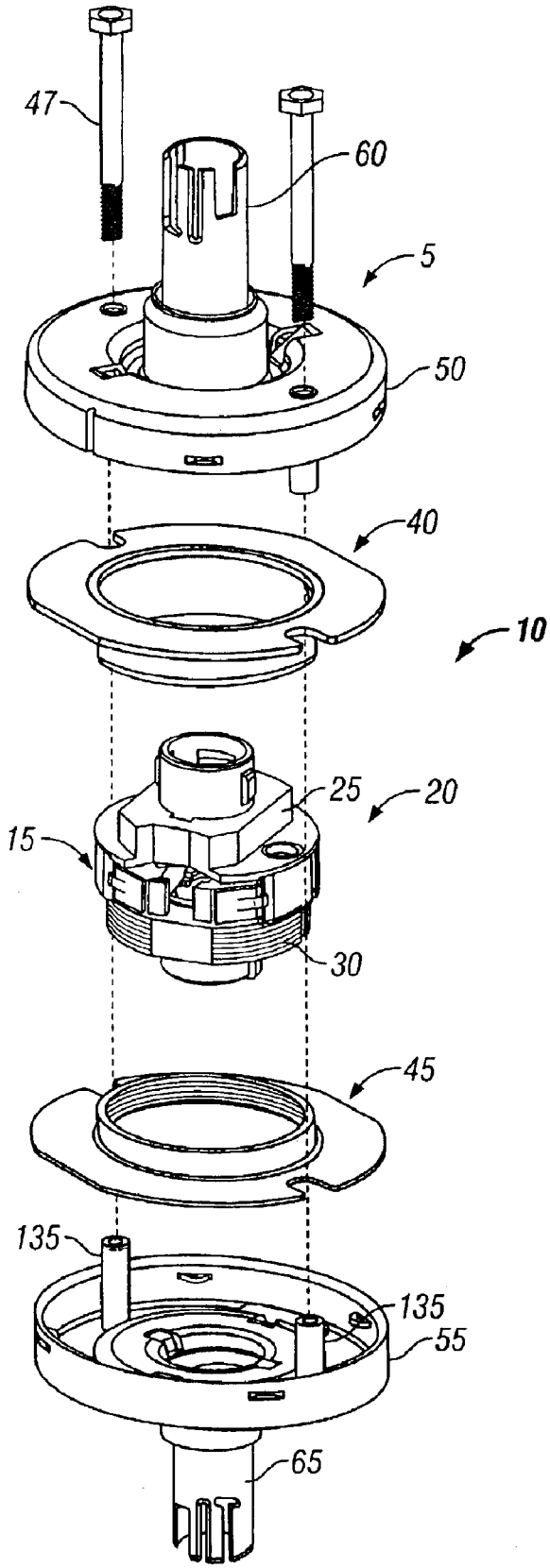
FIG. 1 is a perspective view of an exemplary lock assembly embodying the invention.

FIG. 1 illustrates an exemplary embodiment of the lock assembly 5 of the invention. The lock assembly 5 includes a non-rotational chassis assembly 10 in support of a latch assembly 15. The non-rotational chassis assembly 10 of the invention includes a chassis 20 having a first 25 and a second hub 30, a non-rotational plate 40 that receives the first hub 25, and a threaded plate 45 that receives the second hub 30. At least one connecting element 47 interconnects the non-rotational plate 40 and the threaded plate 45 in constraining the chassis 20 from rotating inside the door. Spring cages 50 and 55 include drive spindles 60 and 65, respectively, that rotate to extend and retract the latch assembly 15 between a locked and an unlocked position, respectively.

Figure 2:
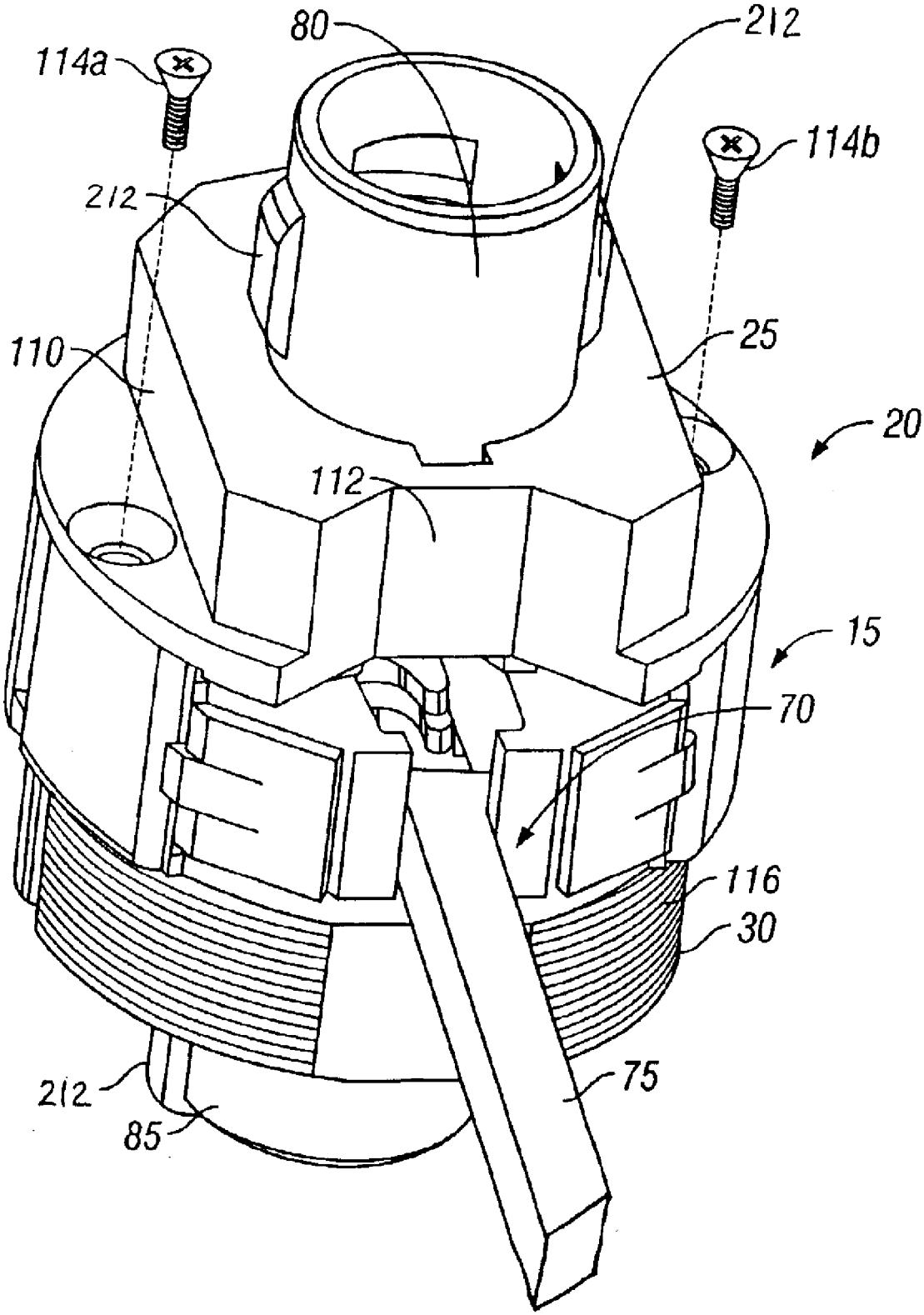
FIG. 2 is a perspective view of a chassis and latch assembly embodying the invention.

FIG. 2 shows a perspective view of an exemplary latch assembly 15 supported by the chassis 20. The latch assembly 15 includes a retractor assembly 70 that extends and retracts a beveled latch or bolt 75 from a locked position to an unlocked position, respectively. Drive shafts 80 and 85 extend from each side of the retractor assembly 70 and pass through openings in the lock chassis assembly 10. Each drive shaft 80 and 85 rotates to move the retractor assembly 70 in a linear direction, thereby retracting and extending the beveled latch 75 to secure access through a door.

The chassis 20 includes the first 25 hub and the second hub 30. The drive shafts 80 and 85 extend through the first 25 and second 30 hubs, respectively, to engage the drive spindles 60 and 65 of the spring cages 50 and 55, respectively. One embodiment of the first hub 25 includes at least one flat side 110. As shown in FIGS. 1 and 2, the exemplary first hub 25 is substantially octagonal-shaped. Of course, the first hub 25 can include other suitable shapes (e.g., square, elliptical, etc.). Another embodiment of the first hub 25 includes a key 112 for aligning the non-rotational plate 40 with the hub 25.

One embodiment of the second hub 30 includes a threaded exterior 116 for receiving the threaded plate 45. In yet another embodiment of the invention, the second hub 30 can include at least one flat side as described above, and the first hub 25 can include the threaded exterior 116. In an alternative embodiment of the invention, both the first 25 and second 30 hubs can include at least one flat side as described above for the first hub 25. However, not providing at least one threaded plate and hub reduces the ability to adjust lock assembly 5 for the thickness of the door.

In one embodiment, the first hub 25 and the second hub 30 are mounted to the lock chassis assembly 10 using mounting screws 114. As shown in FIG. 2, two mounting screws 114*a* and 114*b* secure the hub 25 to the chassis 20. Of course, other suitable connection means (e.g., spot-weld, cast, etc.) known to those in the art can be used. The exemplary embodiment of the first 25 and second 30 hubs of the chassis 20 is comprised of a zinc composition. Of course, the hubs 25 and 30 can be comprised of other suitable materials and compositions (e.g., iron, steel, plastic, etc.) known to those in the art.

Figure 3:
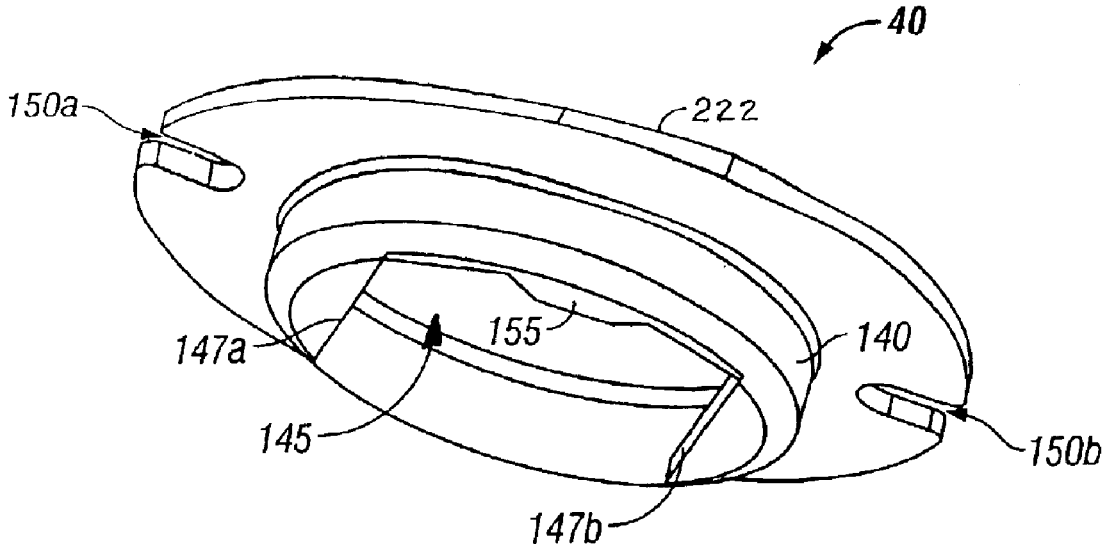
FIG. 3 is a perspective view of a non-rotating plate embodying the invention.

FIG. 3 shows a perspective view of an exemplary non-rotational plate 40 of the invention. The non-rotational plate 40 includes an extension or boss 140 having an opening 145 for receiving the first hub 25 of the chassis. The extension 140 is of length such that the plate 40 lies substantially flush with the top surface of the hub 25. The opening 145 is shaped for receiving the hub 25 of the chassis 20. In one embodiment, the opening 145 includes at least one flat side 147 for engaging the at least one flat side 110 of the chassis 20. In FIG. 3, the exemplary embodiment of the non-rotational plate 40 includes flat sides 147*a* and 147*b* that are compatible for receiving the exemplary hub 25 of the chassis 20 described above. Of course, the opening 145 can take other shapes compatible to receive the hub 25. The non-rotational plate 40 further includes at least one cutout or slot 150 located along the plate's perimeter. FIG. 3 shows an exemplary non-rotational plate 40 having a first 150*a* and second slot 150*b*. The at least one slot 150 engages connector elements 47 extending from the non-rotational plate 40 to the threaded plate 45. The engagement of the slots 150*a* and 150*b* with the connecting elements 47 constrains the chassis 20 from rotating in the door. In another embodiment, the plate 40 can include at least one hole in a position to receive the connector element 47 described above. In another embodiment, the non-rotational plate 40 includes an alignment notch or extension 155 that engages the key 112 in the hub 25.

Figure 4:
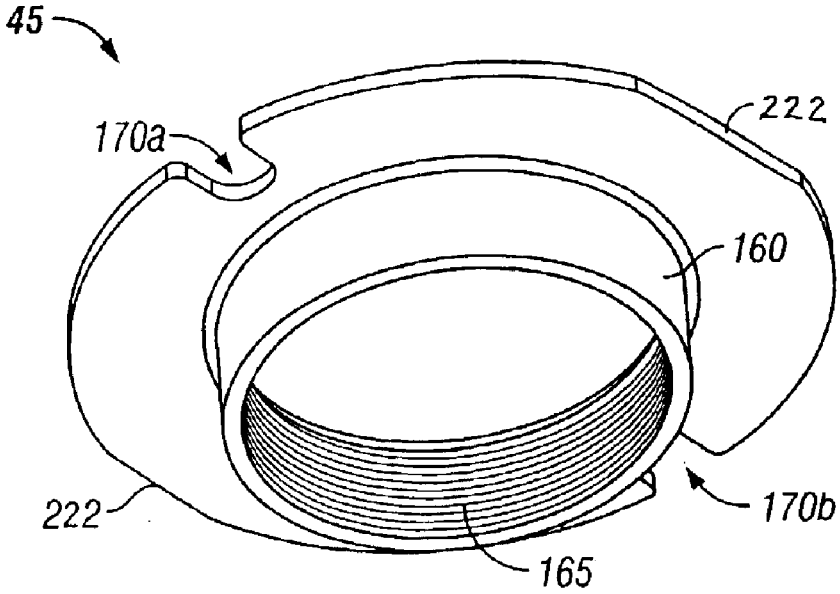
FIG. 4 is a perspective view of a threaded plate embodying the invention.
Figure 5:
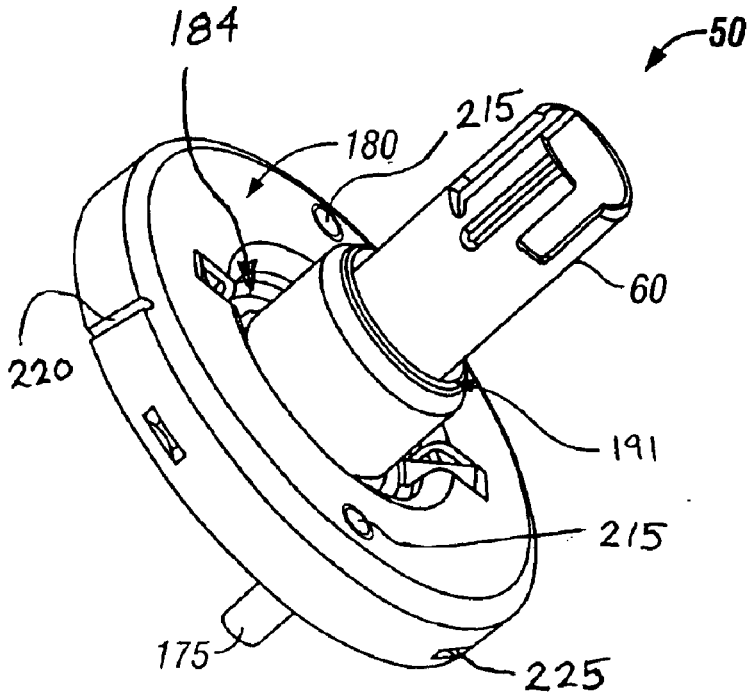
FIG. 5 is a perspective view of a spring cage.

FIG. 4 shows an exemplary threaded plate 45 of the invention. The threaded plate 45 includes an extension or boss 160 having a threaded interior 165. The threaded interior 165 is designed to accept or receive the threaded exterior 116 of the second hub 30 of the chassis 20 described above. The depth of the boss 160 is designed to match the depth of the threaded hub 30. One embodiment of the threaded plate 45 further includes at least one notch or slot 170 located along the plate's perimeter similar to the non-rotational plate 40 described above. FIG. 5 shows the threaded plate 45 having a first 170*a* and second 170*b* slot. The slot 170 is designed to receive and engage the connecting element 47 in constraining the chassis 20 from rotating with actuation of the latch assembly 15. The slots 170 are positioned along the threaded plate 45 to align with the slots 150 of the non-rotational plate 40. The slots 150*a* and 150*b* of the non-rotational plate 40 and slots 170*a* and 170*b* of the threaded plate 45 engage the connector elements 47 in substantially the same manner. Of course, holes or extensions at the non-rotational plate 40 or threaded plate 45 can be used to engage the connecting elements 47.

As noted above the non-rotational plate 40 and threaded plate 65 are interchangeable to match the exterior of the first 25 and second 30 hubs of the chassis 20. One embodiment of the non-rotational plate 40 and threaded plate 65 are comprised of steel. Alternatively, the non-rotational plate 40 and threaded plate 65 can be comprised of other suitable materials (e.g., forged metal, plastic) known to those in the art.

As described above, the connecting elements 47 engage the non-rotational plate 40 and threaded plate 45 in constraining rotation of the chassis 20. In one embodiment, the connecting elements 47 are threaded bolts. Of course, other suitable connecting elements (e.g., rods, etc.) known to those in the art can be used.

Figure 6:
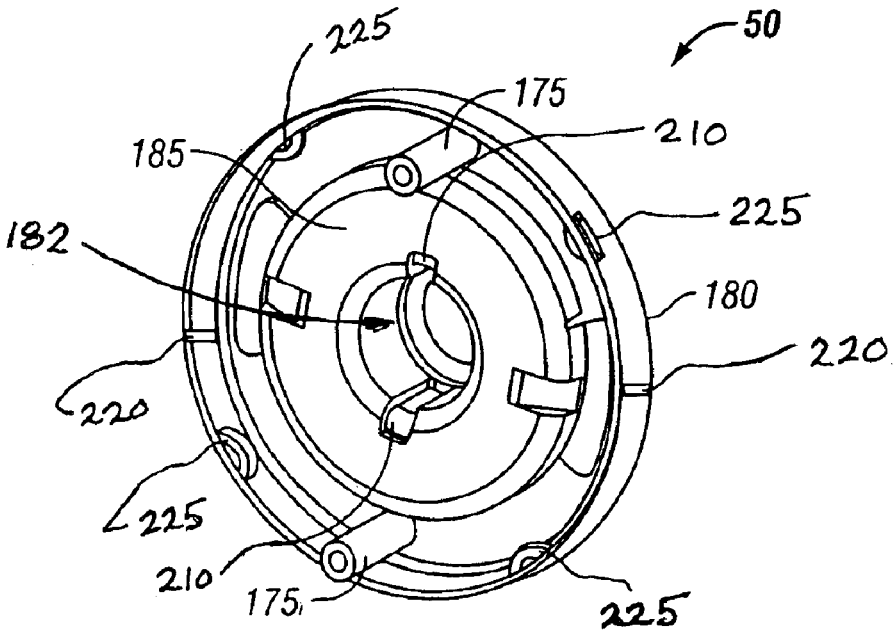
FIG. 6 is a perspective view underneath the spring cage.

As shown in FIGS. 5 and 6, the connecting elements 47 can include interior threaded posts 175 attached at the spring cages 50 and 55. The exemplary posts 175 have a threaded interior for receiving connecting elements 47 having a threaded exterior. The posts 175 can attach at either one or both ends of the connecting elements 47. In another embodiment, slots 150 or 170 of the plates 40 and 45 engage the posts 175 interconnected by the connecting elements 47. Of course, the post 175 can vary in length and be located at one or both spring cages 50 and 55. Any suitable means of connecting the posts 175 to the inside spring cages 50 and 55 can be used. Additionally, other suitable connecting elements 47 (e.g., bolts, nuts, etc.) can be used.

FIGS. 5–8 illustrate one embodiment of the spring cage 50. Many of the elements of the embodiment of spring cage 50 illustrated in FIGS. 5–8 are the same or similar to those used in the embodiment of the spring cage 55 illustrated in FIG. 1 and operate in the same or similar manner. Accordingly, the description of the various elements of spring cage 50 illustrated in FIGS. 5–8 can be found in spring cage 55.

As shown in FIGS. 5 and 6, the spring cage 50 includes the drive spindle 60 extending through a housing or cover 180. One end of the drive spindle 60 connects to a door lever (not shown). The drive spindle 60 passes through an opening 182 surrounded by a boss 184 in the cover 180. A retainer ring 191 is positioned around the spindle 60 at the opening 182 to secure the drive spindle 60 to the cover 180.

Figure 7:
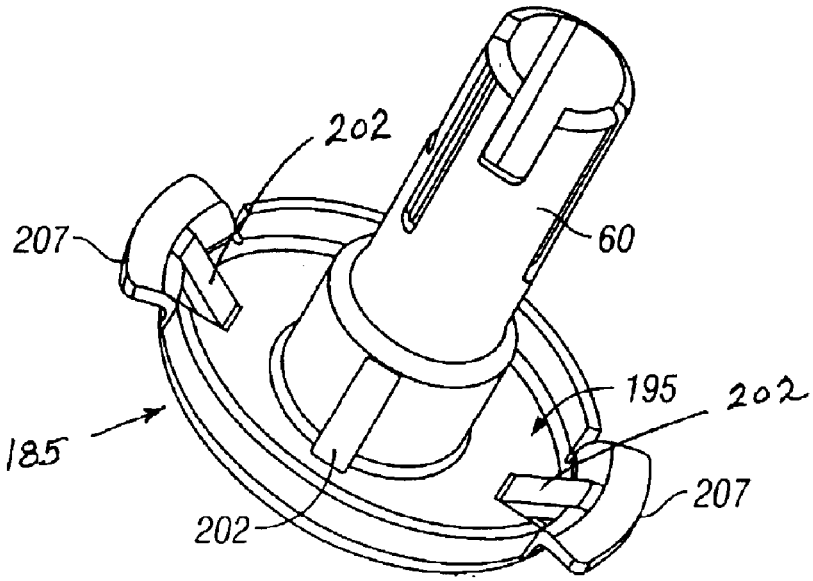
FIG. 7 is a perspective view of an integral drive spindle and torque plate of the invention.
Figure 8:
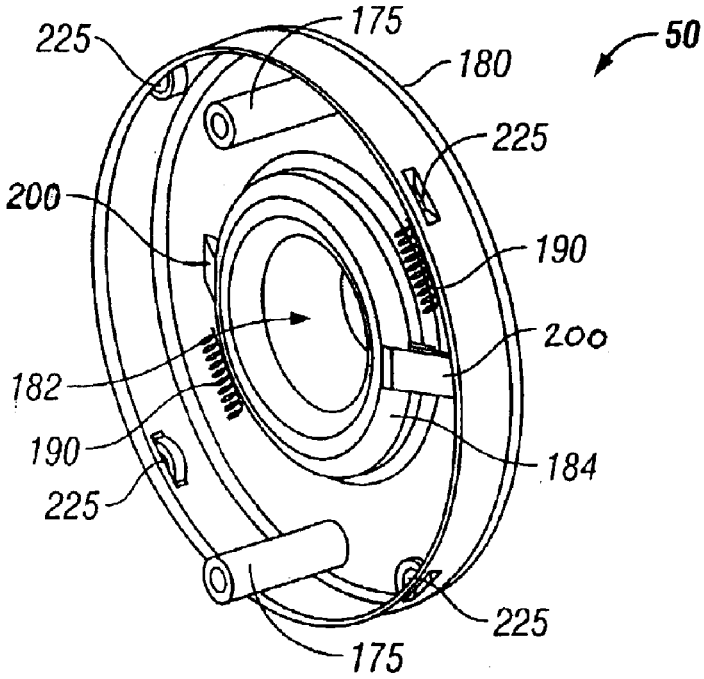
FIG. 8 is a perspective view underneath the housing of the spring cage.

As shown in FIG. 7, the other end of the drive spindle 60 is integral with a torque plate 185 that biases underneath the cover 180. One embodiment of the torque plate 185 includes a hallowed radial area for positioning the springs 190. The hallowed area of the torque plate 185 creates a raceway 195 with the boss 184 of the cover 180 for the positioning the at least one spring or spring components 190. Tabs 200 located radially around the boss 184 of the cover 180 and tabs 202 located radially on the torque plate 185 compress the springs 190. As shown in FIG. 7, at least one spring 190 compressed against the tabs 200 and 202 bias rotation of the drive spindle 60 back to its original position. The embodiment of the integral drive spindle 60 and torque plate 185 provides for ease of assembly of the spring cage assembly 50 as well as reduction of assembly parts, both desirable aspects for installers of these lock assemblies.

Another embodiment of the torque plate 185 also includes tab extensions 207 to support the torque plate under the cover 180. The spring cage assembly 50 can further include a lubricant to reduce friction between the boss 184 and the torque plate 185. As shown in FIG. 5, the exemplary embodiment of the torque plate 185 further includes at least one drive slot 210 that engages extensions 212 at the drive shafts 80 and 85. Engagement of the drive slot 210 and torque plate 185 with the extensions 212 of the drive shaft 80 enables rotation of the door lever (not shown) to extend and retract the latch assembly 15.

The exemplary embodiment of the cover 180 further includes at least one connector opening or slot 215 for receiving the at least one connecting element 47. In one embodiment, the connecting elements 47 extend through the openings 215 to interconnect the spring cages 50 and 55 with the non-rotational plate 40, threaded plate 45, and chassis 20. Another embodiment of the cover 180 includes indentations 220 for receiving dimples in the rose that covers the spring cages 50 or 55. The rose indentations 220 aid in holding the rose in place with respect to the lock assembly 5. The non rotational plate 40 and threaded plate 65 further include a pair of flat portions 222 located along the perimeter. The flat portions 222 provide a space to accommodate the rose indents 220.

As shown in FIGS. 5–8, another embodiment of the cover 180 includes a plurality of plate supports 225 positioned in the interior along the rim of the cover 180. The plate supports 225 support the non-rotational plate 40 and threaded plate 45 positioned underneath the cover 180.

Thus, the invention provides, among other things, lock assembly having an enhanced spring cage assembly. Various features and advantages of the invention are set forth in the following claims.

What is claimed is:

1. A spring cage assembly comprising:

a housing having a centrally located opening and a plurality of housing tabs located radially around the opening and underneath the housing, the housing being connectable with another spring cage assembly and including openings for receiving connecting elements that interconnect the spring cage to the other spring cage;

a plurality of springs located underneath the housing and biased against the housing tabs; and a drive spindle having a first and second end, the first end extending through the opening for connection to a door lever, the second end having an integral torque plate with a plurality of plate tabs, wherein the plate tabs compress the springs against the housing tabs in biasing rotation of the drive spindle.

2. The spring cage assembly as claimed in claim 1, further comprising a retaining ring that retains the drive spindle in the opening of the housing.

3. The spring case assembly as claimed in claim 1, wherein the plate tabs are triangular shaped wedges having an inclined plane facing radially inward.

4. The cage assembly claimed in claim 1, wherein the torque plate further includes at least one slot for engaging the drive shaft of a lock assembly.

5. The spring cage assembly as claimed in claim 1, wherein the torque plate further includes a pair of support tabs extending radially from the torque plate, wherein the support tabs support the torque plate against the housing.

6. The spring cage assembly as claimed in claim 1, wherein the torque plate further includes a raceway that extends radially around the torque plate, wherein the raceway receives the plurality of springs.

7. The spring cage assembly as claimed in claim 1, further comprising an internally threaded post for receiving at least one connecting element that interconnects a first spring cage assembly with a second spring cage assembly.

8. The spring cage assembly as claimed in claim 1, wherein the housing tab is a triangular shaped wedge having an inclined plane facing radially outward from said opening.

9. A door lock assembly for securing a door, comprising:

a door lever;

a latch assembly having a drive shaft, wherein rotation of the drive shaft extends and retracts a latch;

a drive spindle having a first and second end, the first end of the drive spindle connected to the door lever, the second end of the drive spindle integral with a torque plate positioned underneath the housing, the torque plate having at least one slot that engages the drive shaft;

a plurality of springs located between the torque plate and the housing;

a housing having an opening for receiving the drive spindle and a boss extending radially around the opening;

a plurality of plate tabs located radially around the torque plate; and a plurality of housing tabs positioned radially around the boss wherein the plate tabs compress the springs against the housing tabs in biasing rotation of the drive spindle.

10. The door lock assembly as claimed in claim 9, further comprising a retaining ring that retains the drive spindle in the opening of the boss.

11. The door lock assembly as claimed in claim 9, wherein the housing further includes openings for receiving mounting screws.

12. The door lock assembly as claimed in claim 9, wherein the plate tabs are triangular shaped wedges having an inclined plane facing radially inward from the rim.

13. The door lock assembly as claimed in claim 9, wherein the torque plate further includes a plurality of support tabs located along an edge of the rim, the support tabs facing radially outward from and parallel to the housing.

14. The door lock assembly as claimed in claim 9, wherein the housing further includes a rim having indents facing radially inward for supporting a lock chassis.

15. The door lock assembly as claimed in claim 9, wherein the torque plate further includes a groove that extends around a circumference of the raceway such that the groove aligns the spring mechanism in the raceway.

16. The door lock assembly as claimed in claim 9, wherein the openings in the housing includes internally threaded posts for connection to connecting elements and a second spring cage.

17. The door lock assembly as claimed in claim 9, wherein the drive spindle and plate tabs on the torque plate rotate such that the plate tabs compresses the springs against the housing tabs.

18. A spring cage assembly comprising:

a housing having a centrally located opening and a plurality of housing tabs located radially around the opening and underneath the housing;

a plurality of springs located underneath the housing and biased against the housing tabs; and a drive spindle having a first and second end, the first end extending through the opening for connection to a door lever, the second end having an integral torque plate including at least one slot for engaging the drive shaft of a lock assembly and a plurality of plate tabs, wherein the plate tabs compress the spring against the housing tabs in biasing rotation of the drive spindle.

19. A spring cage assembly comprising:

a housing having a centrally located opening and a plurality of housing tabs located radially around the opening and underneath the housing;

a plurality of springs located underneath the housing and biased against the housing tabs; and a drive spindle having a first and second end, the first end extending through the opening for connection to a door lever, the second end having an integral troque plate with a plurality of plate tabs and a pair of support tabs extending radially from the torque plate, wherein the plate tabs compress the springs against the housing tabs in biasing rotation of the drive spindle and the support tabs support the torque plate against the housing.

20. A spring cage assembly comprising:

a housing having a centrally located opening and a plurality of housing tabs located radially around the opening and underneath the housing;

a plurality of springs located underneath the housing and biased against the housing tabs; and a drive spindle having a first and second end, the first end extending through the opening for connection to a door lever, the second end having an integral torque plate with a plurality of plate tabs, wherein the plate tabs compress the springs against the housing tabs in biasing rotation of the drive spindle;

wherein the plate tabs are triangular shaped wedges having an inclined plane facing radially inward.

21. A spring cage assembly comprising:

a housing having a centrally located opening and a plurality of housing tabs located radially around the opening and underneath the housing, each housing tab being a triangular shaped wedge having an inclined plane facing radially outward from said opening;

a plurality of springs located underneath the housing and biased against the housing tabs; and a drive spindle having a first and second end, the first end extending through the opening for connection to a door lever, the second end having an integral torque plate with a plurality of plate tabs, wherein the palte tabs compress the springs against the housing tabs in biasing rotation of the drive spindle.

* * * * *